United States Patent [19]

McKenzie

[11] Patent Number: 4,606,593

[45] Date of Patent: Aug. 19, 1986

[54] ELECTRIC WIRE CONNECTOR

[76] Inventor: Thomas J. McKenzie, 6230 N. Camino Pimeria Alta, Tucson, Ariz. 85718

[21] Appl. No.: 740,857

[22] Filed: Jun. 3, 1985

[51] Int. Cl.[4] ..... H01R 4/48

[52] U.S. Cl. ..... 339/61 R; 339/74 R; 339/260

[58] Field of Search ..... 339/61 R, 61 M, 74 R, 339/204, 205, 256 R, 256 C, 256 S, 260

[56] References Cited

U.S. PATENT DOCUMENTS

| | | | |
|---|---|---|---|
| 1,212,821 | 1/1917 | Schade, Jr. | 339/260 |
| 1,657,253 | 1/1928 | Fortin | 339/256 S |
| 2,370,857 | 3/1945 | Gunzburger | 339/260 |
| 2,394,020 | 2/1946 | Soreny | 339/256 S |

FOREIGN PATENT DOCUMENTS

| | | | |
|---|---|---|---|
| 1485616 | 6/1967 | France | 339/74 R |

*Primary Examiner*—John McQuade

*Attorney, Agent, or Firm*—H. Walter Clum

[57] ABSTRACT

A connector for electrical wire conductors comprising: a plurality of electrically conductive flexible spring wires assembled in a closely aligned side-by-side arrangement, each wire having one or more circumferentially shaped portions extending therefrom along the length thereof and cooperating with each other to form one or more channels for receiving electrical conductors to be interconnected, and a housing to enclose said assembly of wires and having openings permitting the insertion within said channels of the electrical conductors.

10 Claims, 8 Drawing Figures

ELECTRIC WIRE CONNECTOR

BACKGROUND OF THE INVENTION

This application relates to my copending application entitled "Electrical Wire Connector", Ser. No. 726,908, filed Apr. 22, 1985.

Many patents have been directed to electrical connectors. This fact alone is evidence of the need for a really reliable fail-safe connector wherein one can rely upon its ability to maintain a faultless connection of wire conductors. It is well known that many fires have been caused by the failure of connectors now in common use which have been considered safe. The present invention, along with my above identified copending application, was conceived and developed to overcome the faults of the prior art devices and to provide a fail-safe connector enabling the reliable interconnection of electrical conductors.

DESCRIPTION OF THE PRIOR ART

It would be difficult in the limitations of a patent application to describe the multiplicity of patented art in the wire connector field in a fruitless effort to produce a really effective fail-safe connector. However, it can safely be said that except for my coopending application none is known at this time that even remotely relates to my concept wherein a plurality of individual electrically conductive wires are so formed and assembled to provide a novel fail-safe electrical wire connector.

SUMMARY OF THE INVENTION

It is the primary object of the present invention to provide an improved electrical wire connector which enables a secure fail-safe mechanical interconnection of electrical conductors.

Another object is to provide such a connector which is adapted for use in the interconnection of specific guages of wire conductors.

A further object is to provide a connector which is of small size, a factor particularly important in the installation of wiring circuits in building and home construction, and in other manufactures.

Another object is to provide a connector wherein its size may easily be determined by the gauge and electrical carrying capacity of conductors to be interconnected within the connector.

A still further object is to provide a connector which is easily manufactured and assembled and which permits solid or stranded electrical conductors to be easily interconnected merely by inserting them into the connector, thereby eliminating the presently common practice of using clamping devices or tools, and without twisting or bonding, with important savings in the time, labor and expense normally required by connectors now in common use.

BRIEF DESCRIPTION OF THE DRAWINGS

The foregoing and other objects and advantages of the present invention will become apparent from the following description of the accompanying drawings in which.

DESCRIPTION OF THE PREFERRED EMBODIMENT

Figure 1:
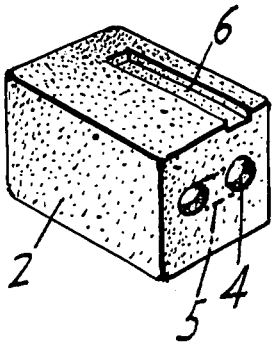
FIG. 1 is a perspective view of a connector embodying the preferred form of the invention.

First with reference to FIG. 1, it is seen that the preferred embodiment of the invention is embodied in a housing 2 of a suitable dialectric material, such as synthetic resin. It is provided with two openings 4 along one side for the insertion of the stripped ends of electrical conductors to be interconnected. While two openings have been shown as preferrable, only one may be provided as illustrated by the broken lines 5. As described later, other openings may be provided. A stripping guide 6 may be provided upon the surface of the housing to guide a user of the connector in the amount of insulation to be stripped from the conductor wire ends prior to insertion into a particular connector.

Figure 2:
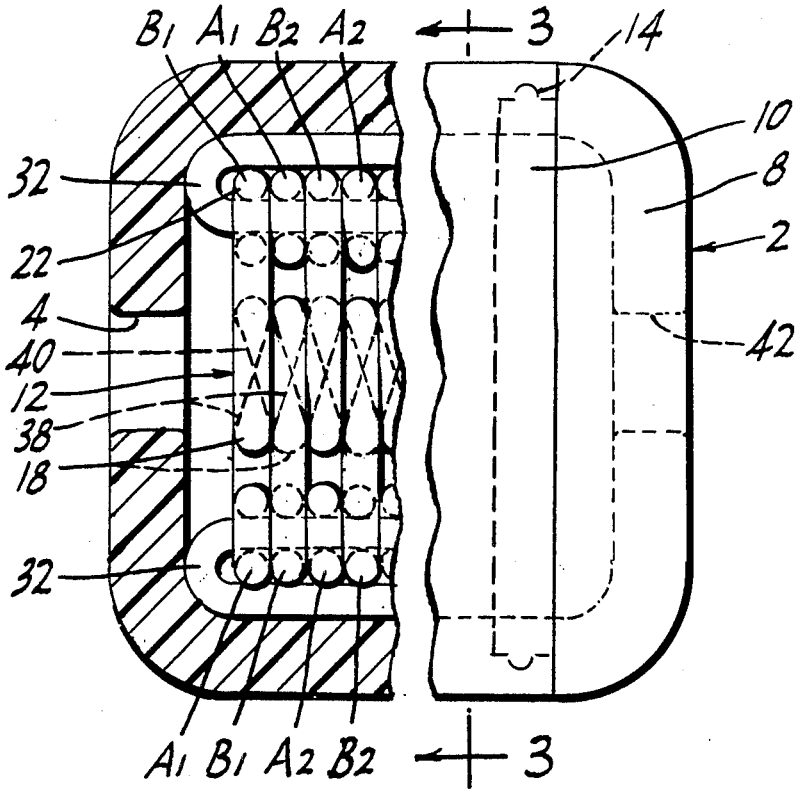
FIG. 2 is an enlarged elevational view of the connector shown in FIG. 1 with parts broken away to show its interior construction.

Now turing to FIG. 2 it is seen that the housing, while not to be considered so limited, is constructed of two parts 8 and 10, part 8 being telescoped into part 10 after the connector assembly 12 has been placed within part 10. Detents 14 are provided releasibly to lock the housing parts together.

The heart of both the preferred and modified forms of the invention, as in my coopending application, resides in the use of a plurality of individual interconnected electrically conductive flexible spring wires 16, preferably of metal, which are in a closely aligned side-by-side, preferably abuting, parallel arrangement one with another, and being provided with portions integrally formed thereon to form one or more channels for the insertion therein and electrical interconnection thereof of wire conductors, all enclosed in a housing in which openings are provided aligned with the channels so to permit the insertion of said conductors, also their removal from the channels.

Figure 3:
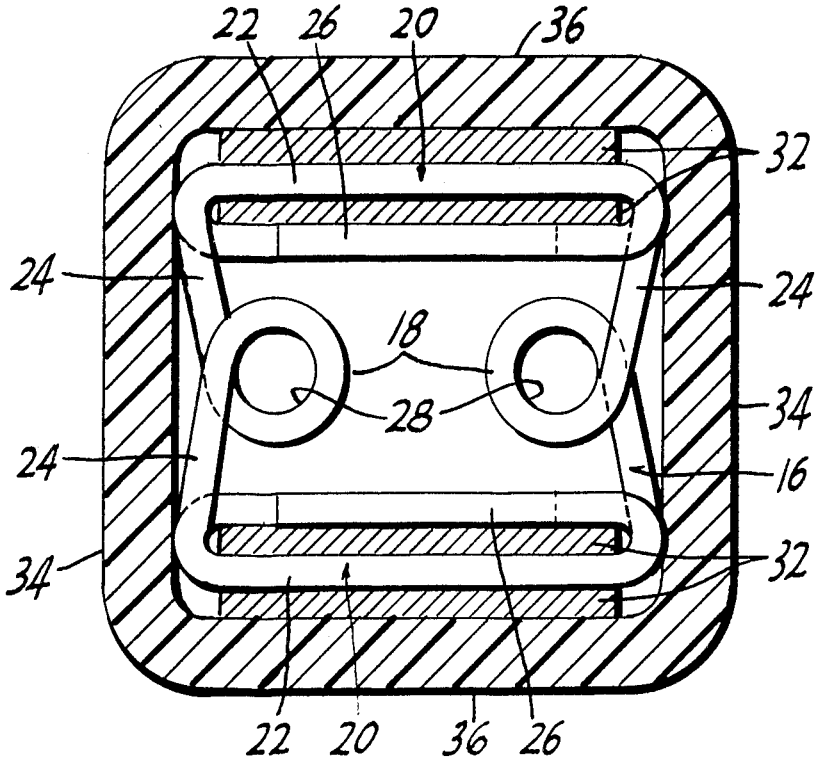
FIG. 3 is a sectional view taken along the line 3—3 of FIG. 2.
Figure 4:
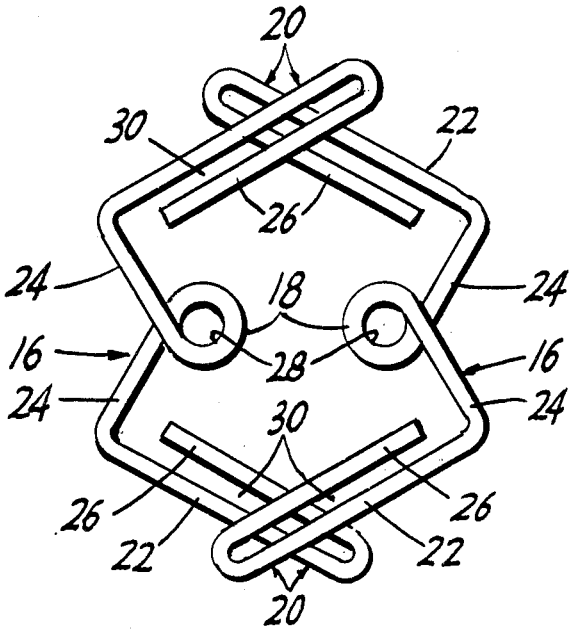
FIG. 4 is a view illustrating the construction of the individual wires forming wire receiving channels in the preferred form of the invention.

With reference to FIG. 4 it is seen that normally before being assembled, as shown in FIG. 3, that portions 22 of wire ends 20 are bent angularly away from portions 24 in which the loops 18 are formed. Then they are turned back parallel with themselves, are indicated by the numeral 26, slightly spaced from portion 22.

When assembling wires 16 in their operative condition, as shown in FIG. 3, to form the wire receiving channels 28, the ends 20 are flexed toward each other until the spaces 30 between wire end portions 22 and 26 are aligned. Then the wires are electrically interconnected by threading a metal strap 32 through the spaces 30 and around end portion 22, as shown more clearly in FIGS. 2 and 3.

Note that flexing the wires into assembly effects a lesser angle between portions 22 and 24. This results in this figure in a preferred spacing between the channel forming loops 18 and the opposite side walls 34 of the housing, with wire portions 24 extending inwardly toward each other. However this angle could be outwardly greater as shown at 90 on FIG. 8 wherein wire portions 92 extend outwardly away from each other. If desired the ends of the wires may be electrically bonded to the strap 32 by some suitable means, such as welding.

It will be seen more clearly in FIG. 4 that the opposite ends 20 of the wires 16 are oppositely overlapping when assembled, thereby assuring their close side-by-side asssembly, as shown in FIG. 2.

While some of the walls of the housing 2 may be of rigid material, those walls 36 over wire ends 20 are formed of a flexible material.

For convenience of description and clear understanding, and with reference to FIG. 2, the alternate wires are designated by the letters "A" and "B" with subnumerals "1" and "2". The "B1" wire portion 24 the first wire on the left of the assembly extends down to its loop 18 which extends upwardly to the right, as indicated by the dotted lines at 38, and then downwardly to be looped about strap 32. The "A1" wire to the right of the first "B1" wire in this figure extends downwardly to its loop 18 which extends upwardly to the left, as indicated by the dotted lines at 40, then downwardly to be looped about strap 32 to the left of the lower end of wire "B1". This arrangement of alternate wires is carried throughout the whole assembly 12 which comprises a plurality of the wires, as indicated by the wires "B2" and "A2". By way of example only, one model constructed and tested in accordance with the concepts of this invention includes some twenty-six (26) of the wires.

Thus it may be understood that electrical conductors may be inserted into the channels 28 through the openings 4 in the housing wherein they are tightly gripped by the accumulated force of the plurality of individual wire loops throughout the channel. The loop openings are of slightly less diameter than the diameter of the conductors for which the particular connector has been designed to accomodate.

Insertion of conductors into channels 28 may be made by finger or other means. However, the grip upon the conductors by the plurality of channel forming loops is such that it is nearly impossible to withdraw the conductors by hand.

An important feature of this invention resides in its novel construction wherein insertion within and withdrawl from the channels of conductors may easily be accomplished merely by finger pressure, or other means, upon the flexible housing walls 36, squeezing the wire ends 20 toward each other, resulting in portions 24 of the wires also moving in opposite directions toward each other causing an enlargement of the loops 18 and consequently the channels 28, sufficiently to permit easy insertion within and withdrawal of conductors, either solid or stranded, therefrom. After insertion of a conductor, release of the pressure upon the housing walls permits the assembly of wires forming the channels to grip the conductor with the accumulated force of the plurality of individual wires making it all but impossible to withdraw the wire from the channels by hand.

The size and electrical carrying capacity of electrical conductors to be interconnected within the channels will control the structural design of each connector. It will determine the amount of surface contact needed between and the number of wires to form a particular channel. It will also control the length and depth of a connector and the construction of wires 16 for assembling a particular connector.

If desired, and as mentioned heretofore, other openings, as indicated at 42, may be provided in the housing wall 8 to permit conductors to be inserted in the channels from either or both ends of the housing 2.

While the preferred form of the invention has been described, it will be obvious to those skilled in the connector art that certain modifications thereof will fall within the scope of the invention.

Figure 5:
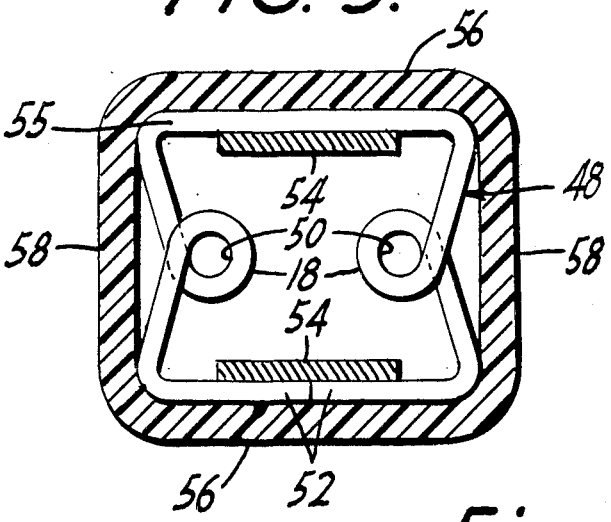
FIG. 5 is an enlarged fragmentary view of one modification of the invention.

One such modification has been illustrated in FIG. 5. In appearance this figure is quite similar to FIG. 3. However, each of the individual wires 48 forming the channels 50 are formed and bonded together differently. Instead of different wires providing the channel forming loops 18, in this modification they are formed in a single wire 48, the ends 52 of which are bonded to a plate 54, as is the intermediate portion 55. It will be understood, of course, that in this, as well as in those modifications yet to be described, a plurality of similar wires are assembled "in-line" to form the channels for receiving conductors to be interconnected, and all are subject to finger pressure, or otherwise, upon the flexible walls to enlarge the loops 18, thereby permitting the easy insertion therein and withdrawal therefrom of conductors to be interconnected or disconnected. It will also be understood that the inner diameter of the loops in all forms of the invention is a bit smaller than the diameter of the conductive wires for which a particular connector has been designed to receive.

Now returning to consideration of FIG. 5, it will be understood that its housing is constructed similarly to that of the preferred embodiment with flexible walls 56 at least at the top and bottom. Also in this modification the loops 18 are spaced from the side walls 58 of the housing. Its operation is the same as that described above relative to the preferred form, wherein squeezing pressure upon flexible walls 56 effects enlargement of the loops 18 and consequently the channels 50, thereby permitting easy insertion within the channels and withdrawl therefrom of conductors, yet tightly gripping conductors inserted therein upon removal of the squeezing pressure upon walls 56.

Figure 6:
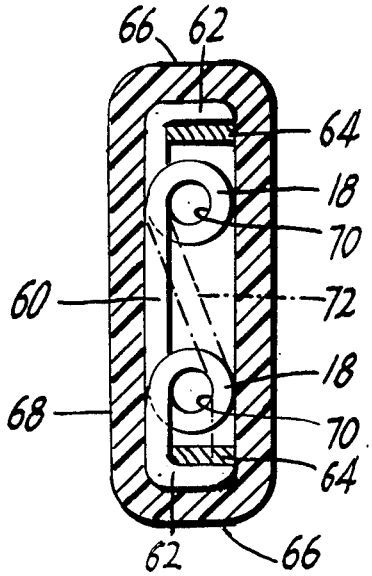
FIG. 6 is a sectional view illustrating another modification of the invention.

In the modification illustrated in FIG. 6 the wire loops 18 are formed "in-line" on induvidual wires 60. Their ends 62 are turned over at right angles and bonded to straps 64 and in contact with flexible walls 66 of housing 68 whereby squeezing of the said walls will press the wire ends toward each other and cause the loops 18 to be enlarged permitting the easy insertion into and removal from the channels 70 of electrical conductors. While in one form of this modification the wire portions between the loops 18 may be in-line, it may, if desired, be at an angle from one side of one loop to the opposite side of the other, as illustrated by the broken lines 72.

Figure 7:
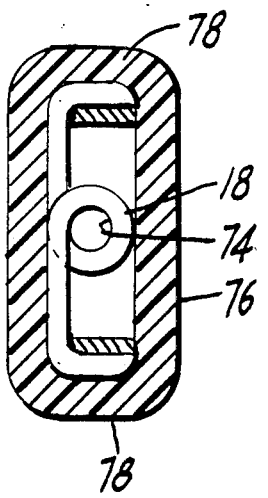
FIG. 7 is a view similar to FIG. 6 but illustrating still another modification.

Another form of the last described modification is illustrated in FIG. 7 wherein only one channel 74 is provided. Openings are included at the opposite ends of the housing 76 to permit insertion in the channel of conductors from the opposite end of the single channel and thereby interconnect said conductors "in-line". As in the other forms of the connector squeezing of the flexible housing walls 78 expedites the easy insertion and removal of conductors from the channels.

Figure 8:
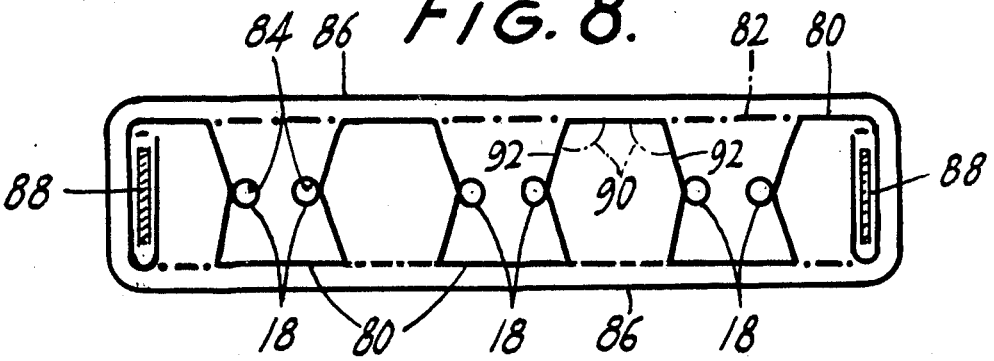
FIG. 8 is a diagrammatic view illustrating yet another modification.

Still another modification is illustrated in the diagrammatic FIG. 8. In this form a plurality of loops 18 are formed on each wire, only two of which are shown and identified by the numberals 80 and 82, the latter in broken lines to distinguish it from 80. Each of the wires, as in the other forms of the invention are identical. However every other one has been turned through 180 degrees with the loops "in-line" to form the channels 84. In other words, wire 82 is the same as wire 80 but has been turned 180 degrees. Thus it is seen that this modification provides any desired number of channels 84 which may be enlarged by pressure upon the flexible walls 86 on opposite sides of the channels to be used. The ends of the wires are bonded to metal plates 88.

From the above description of all forms of the invention illustrated, and others not illustrated, it will be clearly understoood that they provide connectors which will releaseably receive either solid or stranded wire conductors merely by squeezing their flexible walls toward each other thus to enlarge the channels formed by the loops 18.

Throughout the above descriptions, wire gauges have not been mentioned as they are so well known. However, it will not be amiss to mention that in the forms described herein the wire gauges fall within thousandths of an inch and that the other dimensions of the whole assemblies are correspondingly small. By way of example, the wires used in constructing and testing the models of the invention were 0.018 inches in diameter and were of flexible spring metal, such as designated "music wire".

Considering the above descriptions of the preferred and modified forms of the invention, it will now be clearly understood that it provides new and different wire connectors fulfilling the above mentioned and other objects of the invention, as expressed in the following claims.

I claim:

1. An electrical connector comprising:

a dielectric housing having at least a pair of oppositely facing flexible walls;

a plurality of electrically conductive flexible spring wires arranged in a closely aligned parallel assembly one with another and enclosed within said housing;

each of said wires having at least one circumferential loop integrally formed thereon between its ends and arranged to cooperate with the loops of adjoining wires to form at least one channel for receiving electrical conductors to be interconnected;

each of said flexible wires having end portions spaced from opposite sides of its loop;

means bonding said wire ends together;

said ends being arranged in close proximity to the flexible walls of said housing whereby squeezing pressure upon said flexible housing walls, and thereby upon said opposite wire ends moves said wire ends toward each other resulting in the enlargement of said loops thereby permitting easy insertion and removal of said conductors from said channel whose inner diameter is slightly less than the diameter of conductors for which the connector has been designed to accomodate, and whereby when a conductor has been inserted within a channel it will be tightly gripped by the accumulated pressure of the plurality of loops forming the channel; and said housing is provided with openings aligned with the channel openings for the insertion within and removal of conductors from said channels.

2. An electrical wire connector comprising:

a dielectric housing having at least two opposing flexible walls;

a plurality of similarly constructed electrically conductive flexible spring metal wires arranged in a closely parallel assembly one with another within said housing;

each wire having one circumferential loop integrally formed thereon substantially midway between its ends;

the alternate of said wires being oppositly arranged in said assembly whereby their loops are spaced from and cooperating with each other to form two channels for the reception and interconnection of electrical wire conductors;

the opposite ends of said flexible wires extending to and in closely parallel arrangement with the flexible walls of said housing;

means bonding the said opposite ends together whereby squeezing pressure upon said flexible walls and consequently upon said opposite ends of said flexible wires moves said wire ends toward each other resulting in enlargement of said loops sufficiently to permit easy insertion within and removal from said channels of electrical conductors whose diameters are slightly more than the open area of said loops and consequently said channels, and whereby when a conductor has been inserted within a channel it will be tightly gripped by the accumulated pressure of the plurality of loops forming the channel; and said housing is provided with openings aligned with said channel openings to permit the insertion within and removal of conductors from said channels.

3. A construction according to claim 2 wherein:

the angle between the ends of said wires and that portion of said wires connecting said wires ends to said loops is less than 90 degrees thereby spacing said loops inwardly from the walls of said housing.

4. A construction according to claim 2 wherein:

the angle between the ends of said wires and that portion of said wires connecting said wires ends to said loops is greater than 90 degrees thereby spacing said loops outwardly to the walls of said housing.

5. A connector according to claim 2 wherein:

successive pairs of said plurality of flexible wires have their said opposite ends overlapping on opposite sides thereby maintaining their closely parallel assembly.

6. A wire connector according to claim 1 wherein:

each of said flexible wires is formed with at least two circumferential loops spaced from each other along said wires and with the loops of adjoining wires forming at least two channels.

7. A connector according to claim 5 wherein:

that portion of said flexible wires between said spaced loops extend from opposite sides of said loops.

8. A construction according to claim 1 wherein:

each of said individual flexible wires includes a plurality of more than two of said loops, all arranged in a line and cooperating with similarly constructed wires assembled oppositely therewith to form channels equal in number to the loops in each wire;

said channels having slightly less open diameters than the diameters of the conductors for which the connector has been designed to accommodate, whereby when a conductor has been inserted within a channel it will be tightly gripped by the accumulated pressure of the plurality of loops forming the channel; and wherein said flexible walls of said housing extends over and on opposite sides of said channels.

9. A construction according to claim 1 wherein:

each of said wires having at least one circumferential loop having a inner diameter slightly less than the diameter of the conductors for which the connector has been designed to receive.

10. A construction according to claim 2 wherein:

each wire having one circumferential loop having a inner diameter slightly less than the diameter of the conductors for which the connector has been designed to receive.

* * * * *